US005983619A

United States Patent [19]

Tone

[11] Patent Number: 5,983,619

[45] Date of Patent: Nov. 16, 1999

[54] TENSION CONTROL SYSTEM IN FALSE TWIST TEXTURING MACHINE FOR PRODUCING A DOUBLED YARN

[75] Inventor: Shoichi Tone, Kyoto, Japan

[73] Assignee: Murata Kikai Kabushiki Kaisha, Kyoto, Japan

[21] Appl. No.: 09/038,911

[22] Filed: Mar. 12, 1998

[30] Foreign Application Priority Data

Mar. 14, 1997 [JP] Japan ..... 9-081957

[51] Int. Cl.[6] ..... D01H 7/46

[52] U.S. Cl. ..... 57/264; 57/334; 57/336; 57/337

[58] Field of Search ..... 57/264, 332, 334, 57/336, 337

[56] References Cited

U.S. PATENT DOCUMENTS

| | | | |
|---|---|---|---|
| 4,484,436 | 11/1984 | Nakayama et al. | 57/328 |
| 5,146,739 | 9/1992 | Lorenz | 57/264 |
| 5,502,961 | 4/1996 | Tone et al. | 57/336 |

FOREIGN PATENT DOCUMENTS

| | | |
|---|---|---|
| 4-343725 | 11/1992 | Japan . |
| 6-81233 | 3/1994 | Japan . |
| 6-81234 | 3/1994 | Japan . |
| 6-184848 | 7/1994 | Japan . |
| 6-228836 | 8/1994 | Japan . |
| 6-294032 | 10/1994 | Japan . |
| 6-322621 | 11/1994 | Japan . |
| 8-27637 | 1/1996 | Japan . |

*Primary Examiner*—William Stryjewski
*Attorney, Agent, or Firm*—Armstrong, Westerman, Hattori, McLeland and Naughton

[57] ABSTRACT

To provide a tension control system in a false twist texturing machine for producing a doubled yarn wherein the target tension values or allowable ranges of filament yarns y1 and y2 prior to doubling can be individually set for each filament yarn and wherein based on the results of the detection of the tension of the filament yarn prior to doubling, each false twister T for the corresponding filament yarn is individually and independently controlled in such a way that the tension of each filament yarn has the set target tension value or falls within the set allowable tension range. A target tension value and an allowable tension range can be individually set for each filament yarn prior to doubling so as to accommodate the yarn's material, thickness, and structure, and the false twister can be individually and independently controlled based on the results of the detection of the tension of each filament yarn prior to doubling. Consequently, higher-quality doubled false twist texturing yarns can be manufactured.

6 Claims, 6 Drawing Sheets

TENSION CONTROL SYSTEM IN FALSE TWIST TEXTURING MACHINE FOR PRODUCING A DOUBLED YARN

FIELD OF THE INVENTION

The present invention relates to a tension control system in a false twist texturing machine, used for a processing machine such as a draw and a false twist texturing machine to produce a false twist processed SZ doubled yarn.

BACKGROUND OF THE INVENTION

FIG. 6 provides a schematic front view of a false twister in a conventional false twist texturing machine for producing a doubled yarn. The example apparatus shown has a tension control system in the false twist texturing machine, which combines a Z-twisted filament yarn y1 and an S-twisted filament yarn y2 to manufacture a single SZ doubled yarn y. A single tension detector C detects the tension of the SZ doubled yarn formed by combining the Z-twisted filament yarn y1 and the S-twisted filament yarn y2 to adjust the contact pressure between a disc member D and false twisting belt members B1 and B2, which together constitute an SZ simultaneous false twister T.

In the tension control system in the conventional false twist texturing machine; the single tension detector C detects the tension of the SZ doubled yarn to adjust the contact pressure between the disc member D and the false twisting belt members B1 and B2 via a controller so that the detected tension value has a target tension value or falls within an allowable tension range. Thus, since this system does not individually adjust the contact pressure of the false twister T based on the difference in tension between the Z-twisted filament yarn y1 and the S-twisted filament yarn y2, the quality of the SZ doubled yarn y is limited to a certain level and high quality SZ doubled yarn y cannot be manufactured.

In addition, if the material and thickness of the Z- and S-twisted filament yarns y1 and y2 vary, their tensions must be controlled to appropriate values depending on their material and thickness. The conventional false twist texturing machine, however, cannot perform this function.

It is an object of this invention to solve the problem of the tension control system in the conventional false twist texturing machine for producing a doubled yarn.

SUMMARY OF THE INVENTION

To achieve this object, this invention has the following features. The target tension values or allowable ranges of filament yarns prior to doubling can be individually set for each filament yarn, and based on the results of the detection of the tension of the filament yarn prior to doubling, each false twister for the corresponding filament yarn is individually and independently controlled in such a way that the tension of each filament yarn has the set target tension value or falls within the set allowable tension range. An alarm level for the tension of the filament yarn prior to doubling can be individually and independently set for the filament yarn prior to doubling. A control range of values for the false twister that affects the tension of the filament yarn can be independently set for each false twister for the corresponding filament yarn.

DETAILED DESCRIPTION OF THE PREFERRED EMBODIMENTS

Figure 1:
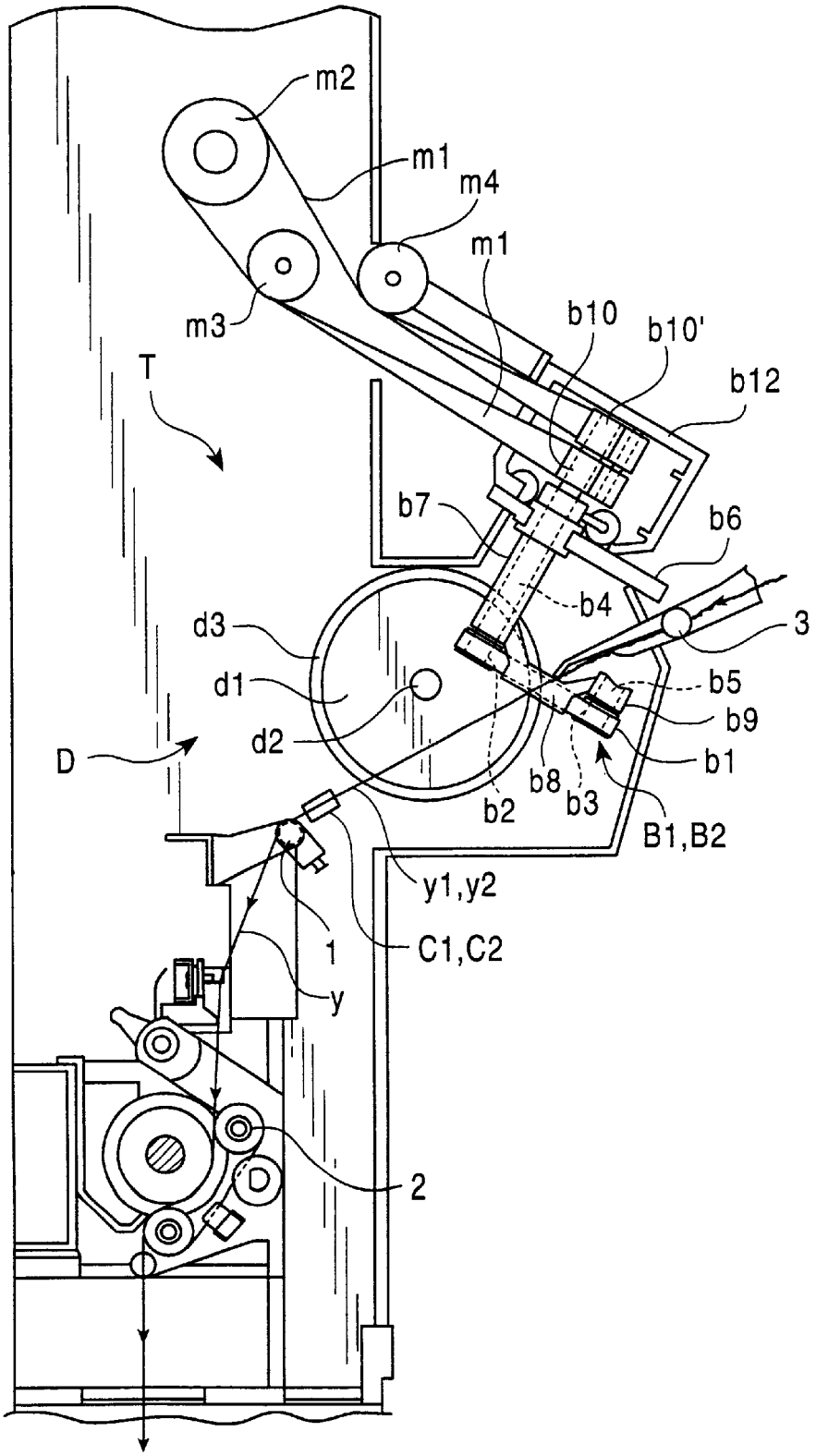
FIG. 1 is a schematic side view of a false twist texturing machine as an example wherein a tension control system according to this invention is applied.

The tension control system in a false twist texturing machine for producing a doubled yarn is described with reference to FIGS. 1 to 5. However, this invention is not limited to these embodiments as long as the spirit and scope of this invention are met.

Reference characters y1 and y2 represent synthetic filament yarns that are heterogeneous (that is, they vary in thickness and material). The filament yarns y1 and y2 are twisted while sandwiched by a disc member D and a false twisting belt member B1 as well as a disc member D and a false twisting belt member B2, constituting an SZ simultaneous false twister T, which is described below, resulting in a Z-twisted filament yarn y1 and an S-twisted filament yarn y2. C1 is a tension detector for detecting the tension of the Z-twisted filament yarn y1 prior to doubling, and C2 is a tension detector for detecting the tension of the S-twisted filament yarn y2 prior to doubling.

In this manner, the tensions of the Z- and S-twisted filament yarns y1 and y2 are detected by the individual tension detectors C1 and C2, respectively. Based on the results of detection by the individual tension detectors C1 and C2, the contact pressure between the disc member D and the false twisting belt member B1 and the contact pressure between the disc member D and the false twisting belt member B2 are individually and independently controlled in such a way that the tension values of the filament yarns y1 and y2 fall within the respective allowable tension ranges, as described below. The tension detectors C1 and C2 are provided on the downstream side (untwisting side) of the false twister T and on the upstream side of a doubling guide 1, which is described below, in order to detect an untwisting tension.

As shown in FIG. 1, in a draw and false twist texturing machine for performing a drawing and false twisting operation, the two filament yarns y1 and y2, which have passed through a known first feed roller, a heater, and a cooling member for cooling the filament yarn and controlling a balloon of the yarn (all these components are not shown in the drawings) and which have then been subjected to Z and S twisting through the false twister T, which is described below, are doubled into an SZ doubled yarn y by a yarn guide 1 and then wound around packages (not shown in the drawings) after passing through a second feed roller 2. Reference numeral 3 represents a yarn guide located on the upstream side of the false twister T.

Reference character d1 indicates a disc constituting the disc member D and mounted on a rotating shaft d2 that is rotated by a drive means such as a motor (not shown in the drawings). The disc d1 may be formed of metal or hard synthetic resin as a rigid body that is difficult to bend, or an elastic body. Reference character d3 indicates a frictional ring section disposed on or near the outer circumference of both surfaces of the disc d1 and having resistance to wear. The frictional ring section d3 may be integrated with the disc d1 or disposed on or near the outer circumference of the disc d1 using lining processing.

Next, the false twisting belt members B1 and B2 mutually opposed so as to sandwich the disc member D therebetween, are described. These belt members B1,B2, however, have the same configuration, so only one of them, that is, the false twisting belt member B1 is fully described. An apostrophe (') is added to the reference numerals of those portions of the other false twisting belt member B2 which correspond to the belt member B1. A false twister for Z-twist is constituted by the disc member D and the false twisting belt B1, and a false twister for S-twist is constituted by the disc member D and the false twisting belt B2.

The false twisting belt b1 of the false twisting belt member B1 is located so as to cross the frictional ring section d3 disposed on the facing side of the disc d1 of the disc member D so that the false twisting belt b1 of the false twisting belt member B1 and the frictional ring section d3 of the disc member D sandwich the filament yarn for twisting.

Reference characters b2 and b3 indicate pulleys attached to the tips of parallel shafts b4 and b5, and the false twisting belt b1 extends between the pulleys b2 and b3. The rotating shaft b4 is supported by a bearing member b7 that is supported by a frame b6, while the rotating shaft b5 is supported by a bearing member b9 attached to the bearing member b7 via an intermediate frame b8. A pulley b10 is attached to the side of the shaft b4 that is opposite to the side to which the pulley b2 is attached. When contacting a drive belt m1, the pulley b10 can be rotated to rotate the pulley b2 to allow the false twisting belt b1 extending between the pulleys b2 and b3 to run as required.

A shaft b4' for the other false twisting belt member B2 is formed so as to be longer than the shaft b4 for the false twisting belt member B1, and a pulley b10' attached to the shaft b4' for the false twisting belt member B2 is located above the pulley b10. The pulley b10 attached to the shaft b4 for the false twisting belt member B1 contacts one of drive belts m1 (described below), which is located lower, while the pulley b10' attached to the shaft b4' for the false twisting belt member B2 contacts the upper drive belts m1. Reference character b11 indicates an idler pulley rotatably supported by a shaft 13 hanging from a frame b12 and sandwiches the drive belt m1 between itself and the pulley b10 attached to the shaft b4 for the false twisting belt member B1 in order to prevent slipping between the drive belt m1 and the pulley b10. A similar idler pulley b11' is provided for the false twisting belt member B2 and the pulley b10'.

The drive belt m1 extends around a pulley m2 attached to an output shaft of a motor (not shown in the drawings) and direction-changing pulleys m3 and m4, and is driven in such a way that the upper and lower drive belts m1 run in opposite directions. The output shaft of the motor can be coupled to the shafts b4 and b4' for the false twisting belt members B1 and B2 directly or via a transmission member in order to rotate the shafts b4 and b4'.

Next, a process is described wherein the SZ simultaneous false twister T of the above configuration applies simultaneously Z and S twisting to two filament yarns, respectively, to manufacture the Z-twisted filament yarn y1 and the S-twisted filament yarn y2, and then combines the yarns together.

One of the filament yarns (the one closer to the reader in FIG. 2) is sandwiched and twisted by the frictional ring section d3 of the disc member D and the false twisting belt b1 of the false twisting belt member B1. Since the disc d1 of the disc member D rotates clockwise while the false twisting belt b1 rotates counterclockwise as seen from the plane, Z twisting is applied to the filament yarn on the upstream side of the false twister T. The Z-twisted yarn is twisted and fixed by the heater on the upstream side and becomes the Z-twisted filament y1.

The other filament yarn (located behind the first filament yarn in FIG. 2) is sandwiched and twisted by the frictional ring section d3 of the disc member D and the false twisting belt b1' of the false twisting belt member B2. Since the disc d1 of the disc member D rotates clockwise while the false twisting belt b1' of the false twisting belt member B2 rotates clockwise as seen from the plane, S twisting is applied to the filament yarn on the upstream side of the false twister T. The S-twisted yarn is twisted and fixed by the heater on the upstream side and becomes the S-twisted filament y2. In this manner, the yarns y1 and y2, simultaneously false-twisted with Z-twist and S-twist by the SZ simultaneous false twister T, are combined by the yarn guide 1.

Figure 2:
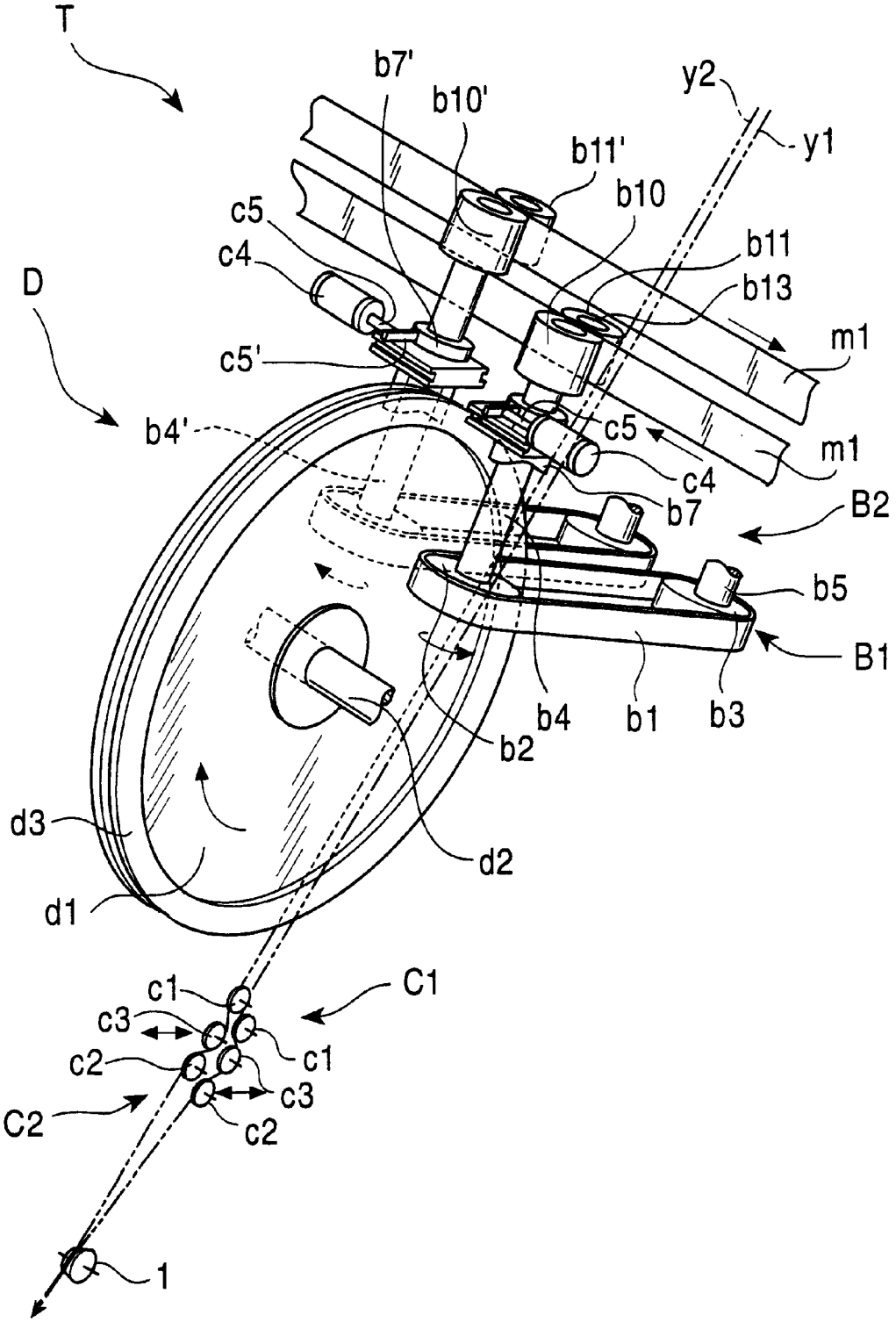
FIG. 2 is schematic enlarged perspective view of an SZ simultaneous false twister as an example wherein a tension control system according to this invention is applied.

As shown in FIG. 2, the Z- and S-twisted filament yarns y1 and y2 pass over the tension detectors C1 and C2 disposed between the false twister T and the yarn guide 1, which doubles the Z- and S-twisted filament yarns y1 and y2. The tension detectors C1 and C2 have fixed guide rollers c1 and c2 which are disposed at a prescribed interval, and a movable guide roller c3 located between the fixed guide rollers c1 and c2, and read the displacement of the movable guide roller c3 that is displaced in response to tension in order to detect the individual tensions of the Z- and S-twisted filament yarns y1 and y2.

Reference character c4 indicates a cylinder disposed on the frame b6, and the tip of a piston rod c5 of the cylinder c4 is attached to an arm section c5' of a bearing member b7'. By operating the cylinder c4 as required to move the piston rod c5 forward and backward, the bearing member b7' is rotated via the arm section c5' to oscillate the false twisting belt member B2 around the bearing member b7'. Thus, the false twisting belt member B2 approaches and leaves the disc member D to enable the contact pressure between the disc member D and the false twisting belt member B2 to be adjusted. A similar cylinder c4 is disposed on the bearing member b7 for the other false twisting belt member B1 to enable the contact pressure between the disc member D and the false twisting belt member B1 to be adjusted. According to this embodiment, the cylinder c4 disposed on the bearing member b7 and the cylinder c4 disposed on the bearing member b7' are mutually opposed in such a way that the piston rods c5 are mutually opposed.

Figure 3:
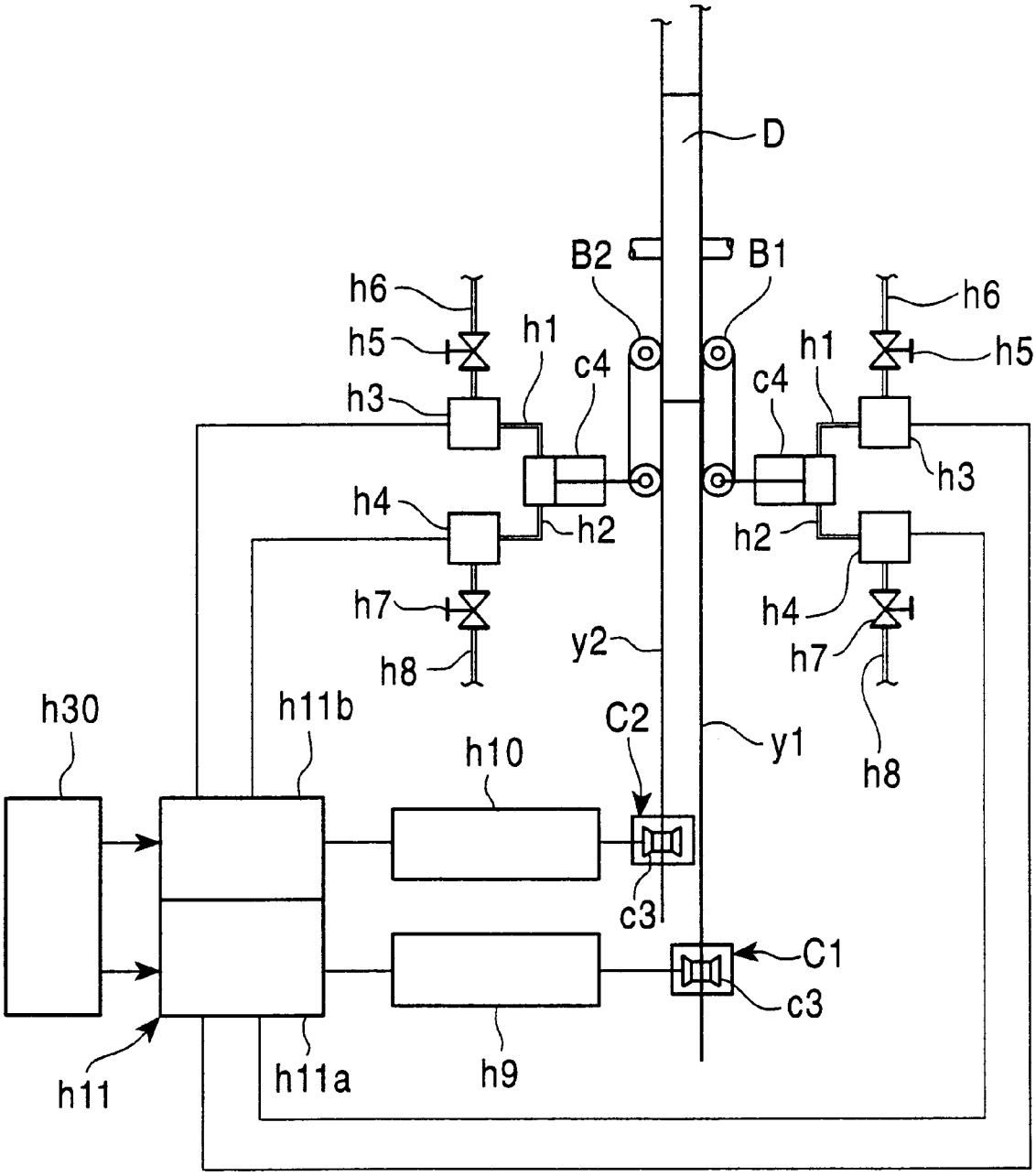
FIG. 3 is a block diagram of one embodiment of the tension control system in a false twist texturing machine according to this invention.

With reference to FIG. 3, a tension control means is now described wherein the cylinders c4 adjust the contact pressures between the disc member D and the false twisting belt members B1 and B2 if the tensions of the Z- and S-twisted filament yarns y1 and y2 deviate from the respective allowable tension ranges which have a predetermined width from the target value, thereby maintaining the tensions within the predetermined allowable tension ranges. In FIG. 3, the mechanism of contact pressure adjustment is simplified.

An air supply tube h1 that supplies an air flow having an upper air pressure limit and an air supply tube h2 that supplies an air flow having a lower air pressure limit are coupled to the cylinder c4, and a first valve h3 and a second valve h4 that control the supply or the stoppage of air flow to the cylinder c4 are disposed on the air supply tubes h1 and h2. An air supply tube h6 coupled to an air supply source (not shown in the drawing) is coupled to the first valve h3 via a pressure regulating valve h5, and an air supply tube h8 coupled to the air supply source (not shown in the drawing) is coupled to the second valve h4 via a pressure regulating valve h7. The pressure regulating valves h5 and h7 can adjust and set the upper and lower air pressure limits for the air flow supplied to the cylinders c4.

Reference character h9 indicates an analog/digital converter that converts into digital data the variations in tension of the Z-twisted filament yarn y1 detected based on the movement of the movable guide roller c3 of the tension detector C1, while h10 is an analog/digital converter that converts into digital data the variations in tension of the S-twisted filament yarn y2 detected by monitoring the movement of the movable guide roller c3 of the tension detector C2.

Reference character h11 indicates a control section in which the target tension values and allowable tension ranges of the Z- and S-twisted filament yarns y1 and y2 are individually and independently set and stored. The control section h11 includes a comparison means for determining whether the tensions of the Z- and S-twisted filament yarns y1 and y2 converted into digital data by the analog/digital converters h9 and h10 fall within the individually and independently set allowable tension ranges, and a control means for determining the open and close of the first or second valve h3 or h4 if the tensions of the Z- and S-twisted filament yarns y1 and y2 deviate from the respective allowable tension ranges. That is, the control section h11 has a Z-twisted filament yarn control section h11*a* and an S-twisted filament yarn control section h11*b*. Reference character h30 is an input means for inputting the target tension values and allowable intervals of the Z- and S-twisted filament yarns y1 and y2. The allowable tension range is calculated from the target tension value and allowable intervals. In this manner, the target tension value and allowable range of each filament yarn can be set individually and independently.

The variations in untwisting tension of the Z- and S-twisted filament yarns y1 and y2 detected based on the movement of the movable guide roller c3 are individually input to the control section h11 via the analog/digital converters h9 and h10. If, for example, the untwisting tension of the Z-twisted filament yarn y1 becomes lower than the lower limit of the allowable tension range, the second valve h4 is opened (with the first valve h3 closed) to supply the air flow having a lower air pressure limit to the cylinder c4 and the contact pressure between the disc member D and the false twisting belt member B1 is reduced to reduce the amount of Z-twisted filament yarn y1 fed in order to increase the untwisting tension of the Z-twisted filament yarn y1.

If the untwisting tension of the Z- twisted filament yarn y1 reaches its allowable range, the second valve h4 is closed. If the untwisting tension of the Z-twisted filament yarn y1 exceeds the upper limit of its allowable tension range, the first valve h3 is opened (with the second valve h4 closed) to supply the air flow having an upper air-pressure limit to the cylinder c4 and the contact pressure between the disc member D and the false twisting belt member B1 is increased to increase the amount of Z-twisted filament yarn y1 fed in order to reduce the untwisting tension of the Z-twisted filament yarn y1.

If the untwisting tension of the Z-twisted filament yarn y1 reaches its allowable range, the first valve h3 is closed. Likewise, the untwisting tension of the S-twisted filament yarn y2 is controlled independently of the control of the tension of the Z-twisted filament yarn y1. In this manner, the untwisting tension can be controlled individually and independently for each filament yarn.

As described above, the magnitude of the contact pressure between the disc member and the false twisting belt affects the untwisting tension of the filament yarn. The contact pressure is determined by the air pressure supplied to the cylinder c4. Thus, the contact and air pressures are control values for the twister that affect the untwisting tension of the filament yarn. These control values each have upper and lower limits, and the control ranges of these values can be adjusted by the pressure-regulating valves h5 and h7 and set for each false twister for the corresponding filament yarn.

Next, another embodiment of the tension control system according to this invention is described with reference to FIGS. 4 and 5. In this embodiment, the tension control system for only the Z-twisted filament yarn y1 has been shown in detail, but the description is also applicable to the tension control system (enclosed by a chain line) for the S-twisted filament yarn y2. The air supply tube h1 that supplies the air flow having an upper air pressure limit to the cylinder c4, the air supply tube h2 that supplies the air flow having a lower air pressure limit to the cylinder c4, the first valve h3, the second valve h4, the pressure regulating valves h5 and h7, the air supply tubes h6 and h8, and the analog/digital converter h9 that converts into digital data the variations in tension of the Z-twisted filament yarn y1 detected based on the movement of the movable guide roller c3 of the tension detector C1 each have the same configuration as in the above embodiment, so their description is omitted.

Reference character h12 indicates a first moving average calculation means for calculating the moving average of the variations in tension of the Z-twisted filament yarn y1 detected via the analog/digital converter h9, while h13 is a second moving average calculation means for calculating the moving average of the variations in tension of the Z-twisted filament yarn y1 detected via the analog/digital converter h9. Reference character h14 indicates an input means for inputting target tension values, allowable intervals around the target values, and allowable error deviations around the target values for which an alarm needs to be issued.

The input means h14 can individually and independently input a target tension value, an allowable tension range (calculated using a target tension value and allowable intervals), and an allowable error deviation associated with the issuance of an alarm (calculated using a target tension value and allowable error deviations) for the Z- and S-twisted filament yarns y1 and y2. Reference indicated h15 indicates a control means for processing and storing input values from the input means h14, as required, this control means h15 supplies the stored target tension value and allowable range to each comparison means described below. The first and second moving average calculation means h12 and h13 can be doubled to provide a single moving average calculation means.

Figure 4:
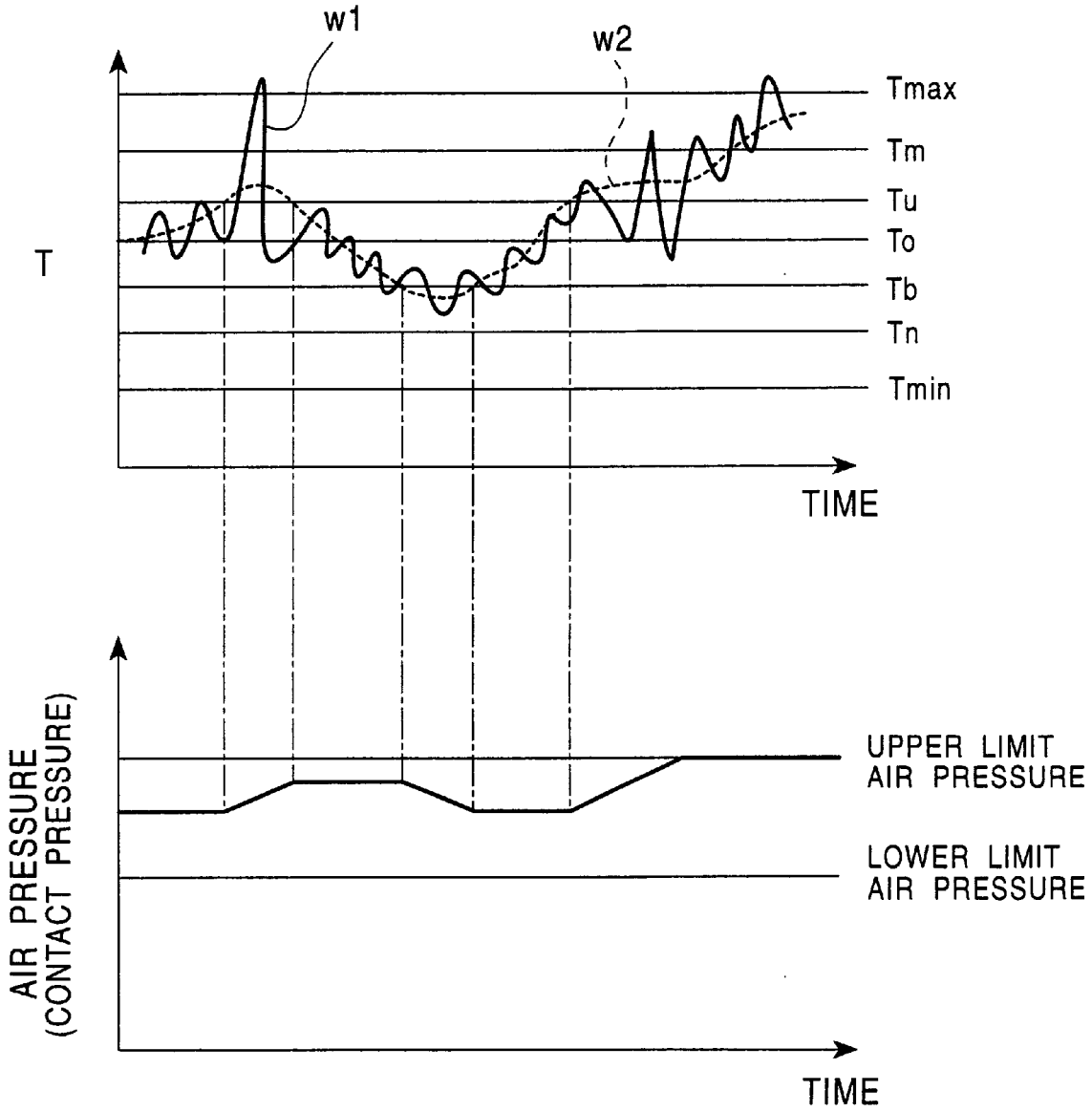
FIG. 4 is a chart of an example of the relationship between the variations in tension of filament yarn and a control value for the false twister.
Figure 5:
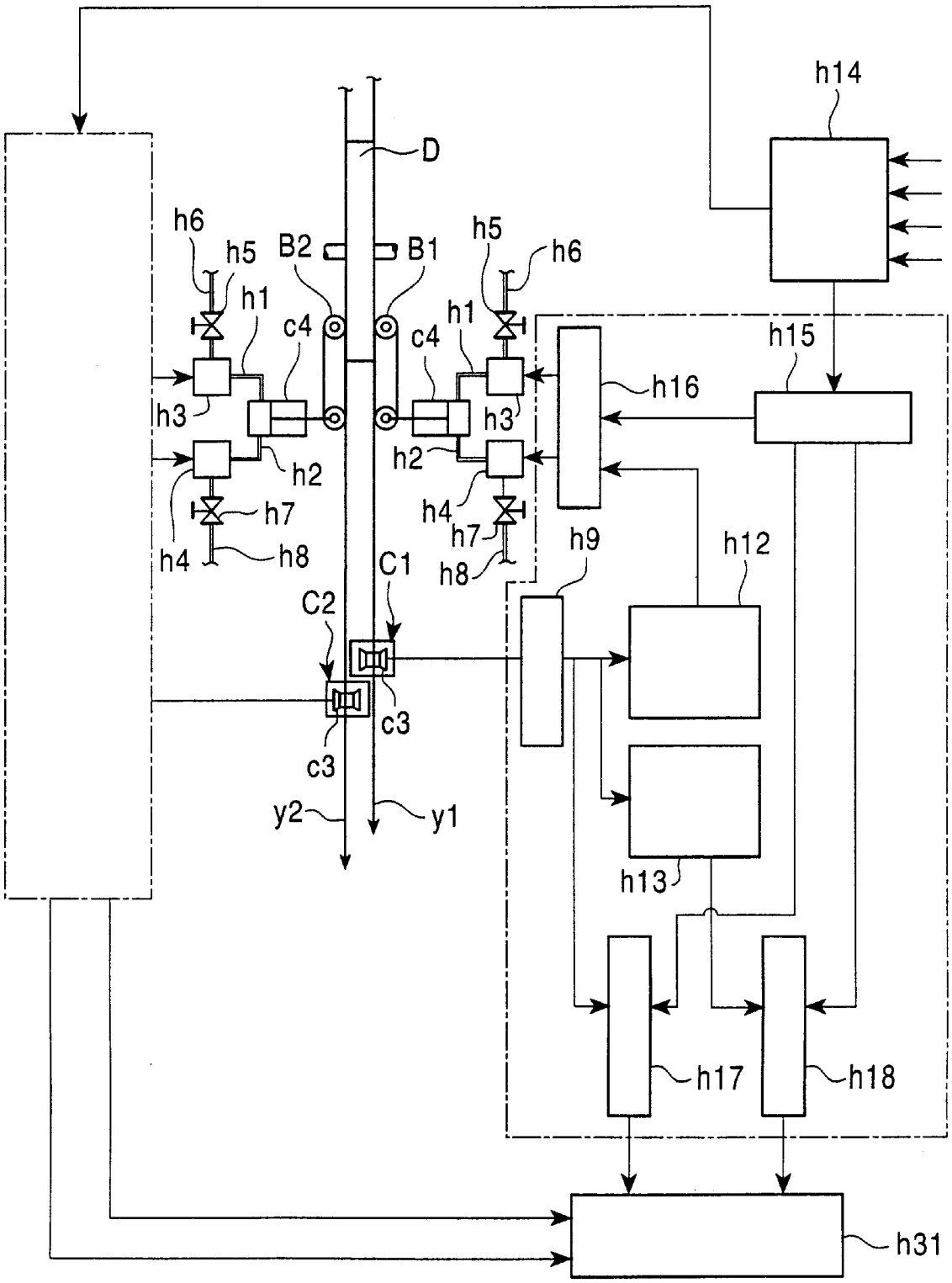
FIG. 5 is a block diagram of another embodiment of the tension control system in a false twist texturing machine according to this invention.
Figure 6:
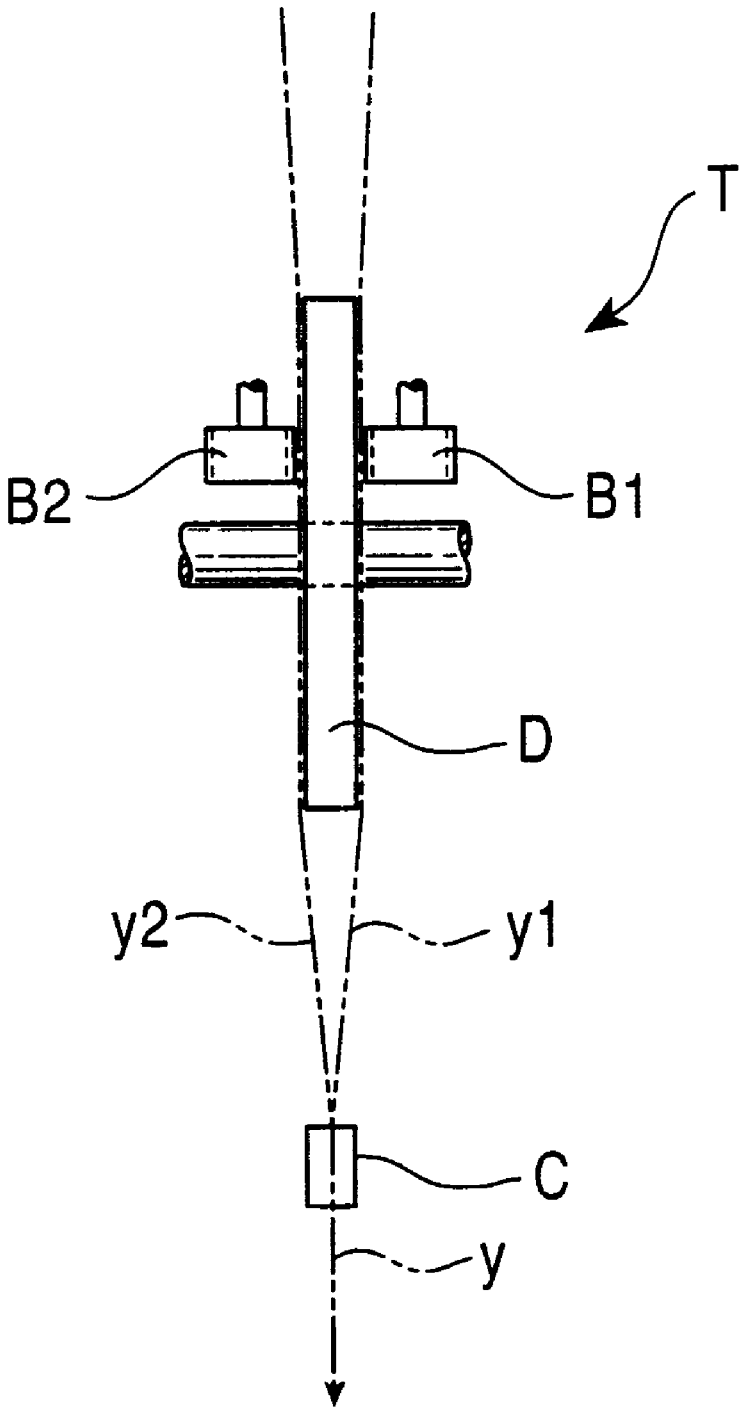
FIG. 6 is a schematic front view of a conventional false twist texturing machine.

The variations in untwisting tension shown by a solid line w1 in FIG. 4 are the instantaneous variations in the untwisting tension of the Z-twisted filament yarn y1 that are converted into digital data by the analog/digital converter h9. The variations in untwisting tension shown by a dotted line w2 are the variations in the untwisting tension moving average of the Z-twisted filament yarn y1 calculated by the first moving average calculation means h12. In order to calculate the untwisting tension moving average, the first moving average calculation means h12 averages several tension values of the Z- twisted filament yarn y1 which have been converted into digital data by the analog/digital converter h9.

The instantaneous variations in the untwisting tension of the Z-twisted filament yarn y1 or the variations in the untwisting tension moving average are vertical around a target tension value To input to the input means h14. Tu is the upper limit value of the allowable tension range and Tb is the lower limit value of the same range.

If the tension moving average w2 of the Z-twisted filament yarn y1 is within the allowable tension range between the upper limit tension value Tu and the lower limit tension value Tb, the tension of the Z-twisted filament yarn y1 is not controlled. That is, the contact pressure between the disc member D and the false twisting belt member B1 does not vary. If, however, the tension moving average w2 of the Z-twisted filament yarn y1 deviates from the allowable tension range, the contact pressure is increased or reduced to control the untwisting tension of the Z-twisted filament yarn y1.

If, in this embodiment, the untwisting tension moving average w2 of the Z-twisted filament yarn y1 deviates from the allowable error deviation between a first alarm upper limit tension value Tm (Tm>Tu) and a lower limit value Tn (Tn<Tb), a signal is sent to an alarm issuance means h31 as described above in order to issue an alarm. Tmax is a second alarm upper limit value set over the first alarm upper limit value Tm, while Tmin is a second lower limit value set below the first alarm lower limit value Tn. If the instantaneous tension of the Z-twisted filament yarn y1 that is converted by the analog/digital converter h9 into digital data exceeds the second alarm upper limit value Tmax or drops below the second alarm lower limit value Tmin, a signal is issued to the alarm issuance means h31 as described below in order to issue an alarm. Since, in this embodiment, the control value for the false twister T has an upper and a lower limits, an untwisting tension error is indicated when a bad supply yarn, a heater error, or a feed roller error occurs (see the right end of FIG. 4). It is also advantageous that unreasonable control is not provided.

Reference character h16 indicates a first comparison means for determining whether the tension moving average of the Z-twisted filament yarn y1 that is calculated by the first moving average calculation means h12 is within the allowable tension range. If the tension moving average of the Z-twisted filament yarn y1 that is calculated by the first moving average calculation means h12 exceeds the upper limit tension value Tu, the first valve h3 is opened (with the second valve h4 closed) to supply the air flow having an upper air pressure limit to the cylinder c4. In this way, the contact pressure between the disc member D and the false twisting belt member B1 is increased. As a result the amount of Z-twisted filament yarn y1 fed increases, and the untwisting tension of the Z-twisted filament yarn y1 is reduced, as described above.

In addition, if the tension moving average of the Z-twisted filament yarn y1 that is calculated by the first moving average calculation means h12 drops below the lower limit tension value Tb, the second valve h4 is opened (with the first valve h3 closed) to supply the air flow having a lower air pressure limit to the cylinder c4. This action reduces the contact pressure between the disc member D and the false twisting belt member B1, and as a result, less Z-twisted filament yarn y1 is fed so as to increase the untwisting tension of the Z-twisted filament yarn y1.

Reference character h17 indicates a second comparison means that compares the second alarm upper and lower limit values Tmax and Tmin with the instantaneous untwisting tension of the Z-twisted filament yarn y1 that is converted by the analog/digital converter h9 into digital data. If the untwisting tension of the Z-twisted filament yarn y1 that is converted by the analog/digital converter h9 into digital data exceeds the second alarm upper limit value Tmax or drops below the second alarm lower limit value Tmin, a signal is sent to the alarm issuance means h31 to issue an alarm.

In addition, the number of times that the tension of the Z-twisted filament yarn y1 that is converted by the analog/digital converter h9 into digital data has exceeded the second alarm upper limit value Tmax or decreased below the second alarm lower limit value Tmin, in other words, the number of times that an alarm signal has been issued is stored in a counter means (not shown in the drawing). If this number rises above a predetermined value set in the counter means, appropriate measures such as the inspection of the false twist texturing machine or the checking of the material or thickness of the Z-twisted filament yarn y1 are taken. This number can be used to control the quality of an SZ doubled yarn y. The described above predetermined value can be set in the counter means individually and independently for the Z- and S-twisted filament yarns y1 and y2.

Reference character h18 indicates a third comparison means for determining whether the tension moving average of the Z-twisted filament yarn y1 that is calculated by the second moving average calculation means h13 is within the allowable tension range between the first alarm upper limit value Tm and the first alarm lower limit value Tn. If the tension moving average of the Z-twisted filament yarn y1 rises above the first alarm upper limit value Tm or drops below the first alarm lower limit value Tn, a signal is transmitted to the alarm issuance means h31 to issue an alarm.

The number of times that the tension moving average of the Z-twisted filament yarn y1 has deviated from the allowable tension range, in other words, the number of times that an alarm signal has occurred, is also stored in the counter means (not shown in the drawing). If this number has exceeded a predetermined value, appropriate measures such as the inspection of the false twist texturing machine or the checking of the material or thickness of the Z-twisted filament yarn y1 are taken. This number can be used to control the quality of an SZ doubled yarn y. The described above predetermined value can be set in the counter means individually and independently for the Z- and S-twisted filament yarns y1 and y2.

The control of the tension of the S-twisted filament yarn y2 is provided independently of the control of the tension of the Z-twisted filament yarn y1. In short, the target tension value To, allowable tension range (Tb to Tn), allowable error deviation (Tn to Tm, Tmin to Tmax), and the control range of the control value for the false twister (lower limit air pressure to upper limit air pressure), shown in FIG. 4, can be individually and independently set for each of the filament yarns y1 and y2, in other words, these values can be set different values for each of the filament yarns y1 and y2.

As described above, according to this invention, the target tension values and allowable ranges of the Z- and S-twisted filament yarns y1 and y2 prior to doubling can be individually and independently set for these filament yarns y1 and y2, and the contact pressure between the disc member D and the false twisting belt member B1 and the contact pressure between the disc member D and the false twisting belt member B2 can be individually controlled so as to correspond to the tension detected by the independently disposed tension detectors C1 and C2. Thus, despite differences in the material or thickness of the Z- and S-twisted filament yarns y1 and y2, an appropriate target tension value and an appropriate allowable tension range can be individually and independently set for each yarn, thereby enabling higher-quality SZ doubled yarn y to be manufactured.

In addition, since the allowable error deviation (alarm level) associated with the issuance of an alarm can be individually set for each filament yarn, high precision quality control can be provided. Furthermore, since the control range of the control value for the twister can be individually adjusted and set for each twister for the corresponding filament yarn, the tension can be controlled for each yarn to enable even higher quality yarn to be manufactured.

According to the above embodiment, the tension control system in a false twist texturing machine according to this invention has been described in conjunction with the example of the manufacturing of the SZ doubled yarn y by combining the Z-twisted filament yarn y1 and the S-twisted filament yarn y2. If, however, two pairs of false twisting belts are used to twist filament yarns, the yarns may be Z-twisted by the respective pairs of false twisting belts, and then doubled together, or S-twisted filament yarns may be doubled together. Furthermore, this invention is not limited to two filament yarns, as three or more filament yarns may be doubled together.

Although in the above embodiment, the false twister T is constituted by disposing the false twisting belt members B1 and B2 in such a way that they are mutually opposed so as to sandwich the disc member D therebetween, a tire-like drum can be used instead of the false twisting belts B1 and B2 to allow the filament yarn to be sandwiched between the surface of the drum corresponding to the tread surface of the tire and the frictional ring section d3 of the disc member D, thereby enabling the filament yarns to be Z- and S-twisted.

In addition, although this invention has been described in conjunction with the false twisting belt members B1 and B2 contacting the respective sides of the single disc member D, two disc members D can be provided to allow whereby the false twisting members B1 and B2 to contact the different disc members D. By further allowing the disc members D to rotate independently, not only the contact pressure but also the rotational speed of the disc or belt can be used to control the tension.

This invention is applicable not only to the control of untwisting tension but also to the control of the twisting tension on the upstream side of the twister. As the false twister, a so-called friction disc type may be used in which multiple discs are located on each of multiple rotating shafts at a predetermined interval and in which the yarn is allowed to contact the multiple discs on the rotating shaft in a zigzag manner so that the multiple rotating shafts can be rotated to apply false twisting to the yarn.

This invention is configured as described above and thus has the following effects.

An appropriate target tension value and an appropriate allowable tension range can be individually set for each filament yarn prior to doubling so as to accommodate the yarn's material, thickness, and structure, and the false twister can be individually and independently controlled based on the results of the detection of the tension of each filament yarn prior to doubling. Consequently, higher-quality doubled false twist texturing yarns can be manufactured. In addition, heterogeneous yarns can be simultaneously twisted. For example, 75-denier yarn may be processed simultaneously with 150-denier yarn, normal yarn may be processed simultaneously with cation yarn, or polyester yarn may be processed simultaneously with nylon yarn.

A control value for the tension of each filament yarn prior to doubling can be individually and independently set prior to doubling. As a result, the false twister can be inspected efficiently and the quality of the twisted yarn can be controlled appropriately.

I claim:

1. A false twist texturing machine for producing a doubled yarn from a plurality of filament yarns, comprising:

means for imparting a false twist in each of said filament yarns;

a doubling guide disposed downstream of said false twist imparting means;

means for varying operation of said false twist imparting means to vary a tension in each of said filament yarns delivered to said doubling guide; and a tension control system for controlling operation of said false twist operation varying means including:

a tension detector associated with each of said filament yarns intermediate said false twist imparting means and said doubling guide;

means for setting target tension values or allowable tension ranges for each of said filament yarns;

means for independently comparing a tension detected by each said tension detector with a set target tension value for each said filament yarn; and means operable in response to the difference between said set target tension value or said allowable tension range and said detected tension in each of said filament yarns for varying the operation of said false twist imparting means associated with each respective filament yarn.

2. A tension control system for a false twist texturing machine according to claim 1 including an alarm; and means operable to actuate said alarm when said detected tension of a filament yarn falls outside a predetermined range of tension values.

3. A tension control system according to claim 1 or claim 2 including means for independently setting a target tension value or allowable range of tension for each filament yarn for controlling operation of said means for imparting a false twist to each said filament yarn.

4. A tension control system in a false twist texturing machine according to claim 3 in which said false twist imparting means includes means for sandwiching said filament yarn between a pair of twisting members and in which a control value for each false twist imparting means is the value of control pressure between said twisting members and the associated yarn filament.

5. A tension control system in a false twist texturing machine according to claim 4 in which said filament yarn sandwiching means includes a rotatable disc member and a false twisting belt member and said doubling guide receives a pair of filament yarns for doubling.

6. A tension control system in a false twist texturing machine according to claim 5 in which two filament yarns are doubled, and said disc member is common to a pair of false twisting belt members, each being operable to sandwich a filament yarn on opposite sides of said disc member.

* * * * *